US008669746B2

(12) United States Patent
Brueckl et al.

(10) Patent No.: US 8,669,746 B2
(45) **Date of Patent: *Mar. 11, 2014**

(54) ON-LOAD TAP CHANGER COMPRISING SEMICONDUCTOR SWITCHING ELEMENTS

(75) Inventors: Oliver Brueckl, Waldmuenchen (DE); Dieter Dohnal, Lappersdorf (DE); Hans-Henning Lessmann-Mieske, Neutraubling (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 234 days.

This patent is subject to a terminal disclaimer.

(21) Appl. No.: 13/129,598

(22) PCT Filed: Feb. 6, 2010

(86) PCT No.: PCT/EP2010/000751

§ 371 (c)(1),
(2), (4) Date: Oct. 13, 2011

(87) PCT Pub. No.: WO2010/115486

PCT Pub. Date: Oct. 14, 2010

(65) Prior Publication Data

US 2012/0025789 A1 Feb. 2, 2012

(30) Foreign Application Priority Data

Apr. 9, 2009 (DE) ..... 10 2009 017 197

(51) Int. Cl.
*G05F 1/16* (2006.01)
*G05F 1/14* (2006.01)

(52) U.S. Cl.
USPC ..... 323/258; 323/255

(58) Field of Classification Search
USPC ..... 323/255–258, 340–343; 336/137–150; 307/78, 85, 104, 112–113, 134, 137
See application file for complete search history.

(56) References Cited

U.S. PATENT DOCUMENTS

| | | | | |
|---|---|---|---|---|
| 4,201,938 | A * | 5/1980 | Neumann | 323/343 |
| 5,006,784 | A | 4/1991 | Sonntagbauer | |
| 5,969,511 | A | 10/1999 | Asselman | |
| 6,856,122 | B2 * | 2/2005 | Dohnal et al. | 323/258 |
| 6,924,631 | B2 * | 8/2005 | Hauer | 323/255 |
| 7,656,138 | B2 * | 2/2010 | Dohnal | 323/258 |
| 2012/0032654 | A1 * | 2/2012 | Brueckl et al. | 323/258 |

FOREIGN PATENT DOCUMENTS

| | | | |
|---|---|---|---|
| DE | 1763075 | A | 8/1971 |
| DE | 2612922 | A | 9/1977 |
| EP | 0124904 | A | 11/1984 |

* cited by examiner

*Primary Examiner* — Timothy J Dole
*Assistant Examiner* — Ivan Laboy Andino
(74) *Attorney, Agent, or Firm* — Andrew Wilford

(57) ABSTRACT

The invention relates to an on-load tap changer comprising semiconductor switching elements for uninterrupted switching between winding taps of a tapped transformer. According to the invention, contact bars are provided which extend in the direction of the path of the fixed tap contacts and can be contacted using contact bridges that can be jointly moved by a contact slide in such a way that direct electrical connections to the charge diverter and electrical connections to the inputs and the output of the semiconductor switching elements can be established.

9 Claims, 2 Drawing Sheets

ON-LOAD TAP CHANGER COMPRISING SEMICONDUCTOR SWITCHING ELEMENTS

CROSS REFERENCE TO RELATED APPLICATIONS

This application is the US-national stage of PCT application PCT/EP2010/000751 filed 6 Feb. 2010, published 14 Oct. 2010 as WO2010/115486, and claiming the priority of German patent application 102009017197.5 itself filed 9 Apr. 2009.

FIELD OF THE INVENTION

The invention relates to a tap changer with semiconductor switching elements for uninterrupted switching between winding taps of a tapped transformer.

BACKGROUND OF THE INVENTION

Such a tap changer is known from WO 97/05536 [U.S. Pat. No. 5,969,511). In this known tap changer two load branches connectable with the respective winding taps are provided, wherein each of the two load branches is connectable by the semiconductor switching elements and can be electrically connected with a common load shunt. By contrast to usual tap changers with mechanical contacts for load switching or also the tap changer with vacuum switching cells for load switching, the known tap changer with semiconductor switching elements does not require any switch-over resistances It is disadvantageous with this known tap changer that electronic power semiconductor switching elements are constantly loaded, even in unchanging operation, by the tap voltage.

It is the object of the invention to eliminate this disadvantage in the case of a tap changer according to category and to indicate a solution in which the electronic power components are cleared in unchanging operation.

A tap changer with a thyristor pair is, in fact, already known from WO 88/10502 [U.S. Pat. No. 5,006,784] in which in unchanging operation the current feed is taken over by a mechanical permanent main contact. However, this solution concerns a so-termed hybrid switch with a separate load changeover switch with numerous mechanical contacts, in which with use of a force store a rapid switching between the two winding taps of the tapped transformer is realized by means of a switch-over resistance that can be temporarily switched on. In the case of the invention, thereagainst, there shall be no need at all for switch-over resistances.

SUMMARY OF THE INVENTION

The general inventive concept is based on providing a movable contact carriage of electrically insulating material on which several electrically conductive contact bridges are fixedly arranged and can be moved together with the contact carriage between the winding taps Accordingly, in the case of each switching a movement in common of all contact bridges from the winding tap that is to be left to the winding tap that is to be switched over to takes place According to the invention, one of the contact bridges, namely the shunt contact bridge, on each occasion in the unchanging state directly connects the currently connected winding tap, i.e. the corresponding fixed contact of the tap changer, with the load shunt.

Overall, in the case of the invention a simple switching as well as a simple contacting or connecting of the semiconductor components during switching in fixed time sequence, i.e. switching sequence, results due to the respective contact bridges. Moreover, a switching free, i.e. electrical unloading of the semiconductor components, takes place in unchanging operation in simple manner by a further contact bridge, namely the shunt contact bridge that directly cooperates with the load shunt.

BRIEF DESCRIPTION OF THE DRAWING

The invention will be explained in more detail in the following by way of exemplifying embodiments, in which.

SPECIFIC DESCRIPTION OF THE INVENTION

Figure 1:
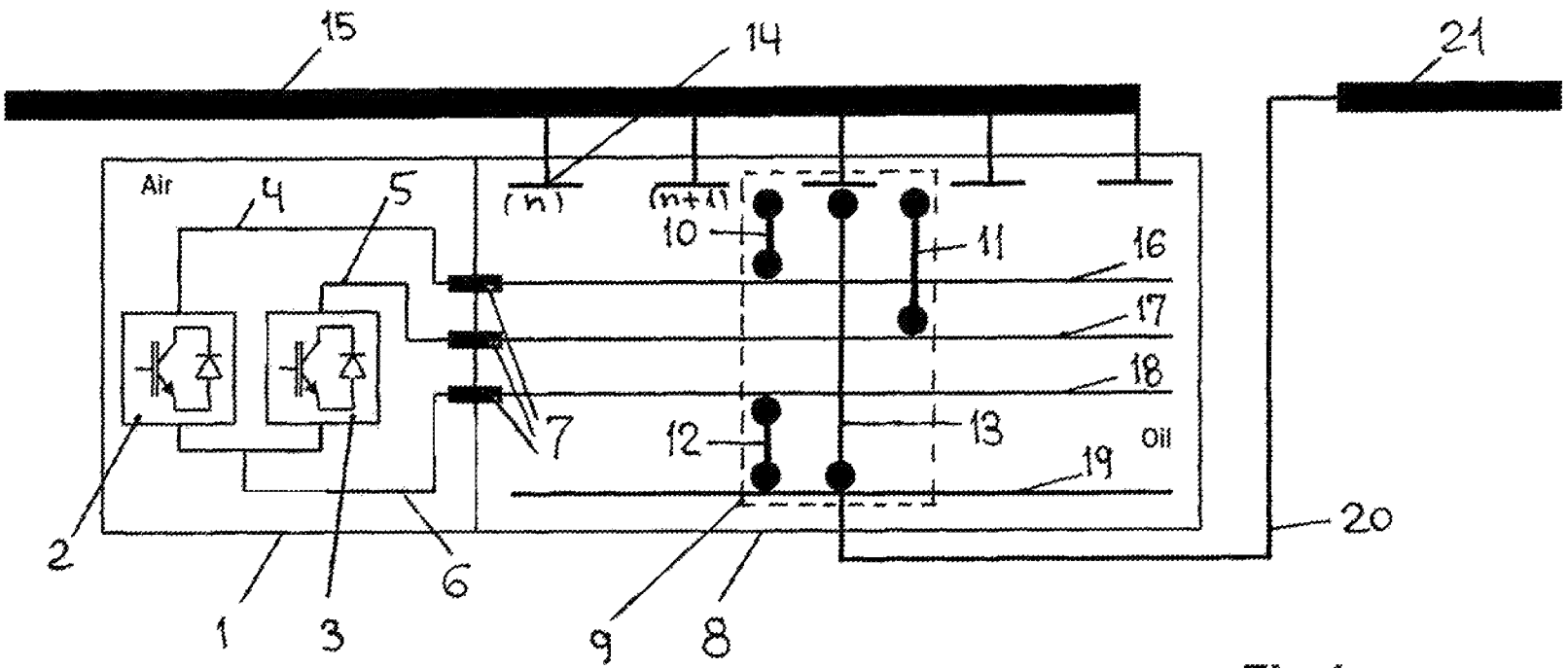
FIG. 1 shows a tap changer according to the invention in schematic illustration and FIG. 2 shows a further form of embodiment of a tap changer according to the invention.

A tap changer comprising an electronic power load changeover switch 1 is shown in FIG. 1. In that case, two semiconductor switches 2 and 3 are provided that each have a respective electrical input 4 or 5 and have a common electrical output 6. The electrical inputs 4, 5 and the electrical output 6 are guided by means of passages 7 in a mechanical contact system 8

The mechanical contact system 8 comprises a contact carriage 9 that is indicated in the figure merely by a dashed line. The contact carriage 9 has contact bridges 10, 11, 12, 13 fixedly arranged thereon. The contact bridges 10 to 13 are electrically conductive, but insulated relative to one another; they have at their ends intrinsically known contact rollers, wiper arrangements or comparable means that are merely indicated in the figure. Each of the tap contacts 14 illustrated in the figure corresponds with a winding tap n, n+1, of the regulating winding 15 of the tapped transformer. In addition provided in the mechanical contact system are three contact rails 16, 17, 18 that are each electrically conductive and each of which is electrically connected with a respective one of the electrical input 4, the electrical input 5 and the electrical output 6 of the semiconductor switches 2, 3.

In addition, a shunt contact rail 19 is arranged in the mechanical contact system and is electrically connected with the actual load shunt 20 that in turn leads to the main winding 21 of the tapped transformer.

In the form of embodiment shown here the contact rails 16 to 18 and the shunt contact rail 19 extend parallel to one another; in this regard the contact carriage 9 executes a linear, straight-line movement for the contact-making.

The first contact bridge 10 can be connected at one of its free ends with the tap changer contacts 14 and at its other free end it runs on the contact rail 16 that is electrically connected with the input 8 of the first semiconductor switch 2. The second contact bridge 11 can be similarly connected at one free end thereof with the fixed tap changer contacts 14 and at its other free end it runs on the further contact rail 17 that is electrically connected with the input 5 of the second semiconductor switch 3. The third contact bridge 12 runs by one of its free ends on the contact rail 18 that is electrically connected with the common electrical output 6 of the electronic power switch. Its other free end runs on the shunt contact rail 19. Physically arranged between the two mentioned contact bridges 10 and 11 is the further contact bridge 13, namely the shunt contact bridge that can be contacted at one free end thereof with the fixed tap changer contacts 14 and runs at its other end on the shunt contact rail 19.

Figure 2:
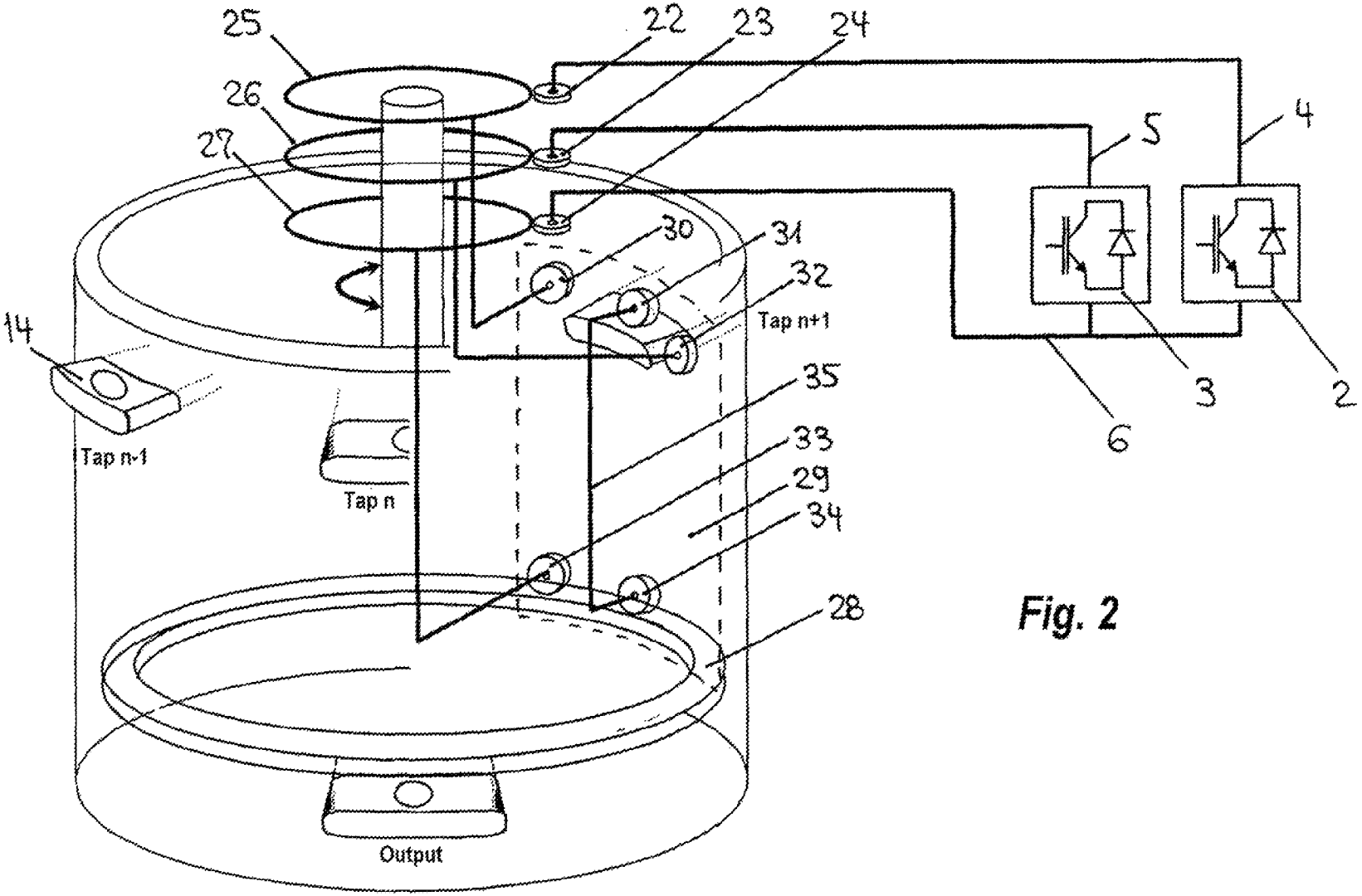

It can be seen that not only the contact bridge 12 and thus the common output 6 of the electronic power load changeover switch, but also the contact bridge 13 are electrically connected with the shunt contact rail 19, i.e. the load shunt 20. In unchanging operation the contact bridge 13 takes over the direct electrical connection between the respective tap changer contact 14 and the load shunt 20. The contact bridges 10 and 11 that lead to the inputs of the electronic power load changeover switch 1, are not connected thereto; the semiconductor switches 2 and 3 are cleared. In the case of a load changeover the contact carriage 9 is moved to the left or the right, depending on whether switching is to be in the direction "higher" or "lower." As a consequence, one of the two contact bridges 10 and 11 runs onto the new tap changer contact 14 to be connected and thus produces an electrical connection with the corresponding input 4 or 5 of the respective semiconductor switch 2 or 3. At the same time the contact bridge 13 comes out of contact. The switching is concluded when the contact carriage 9 has been moved on to such an extent that the contact bridges 10 and 11 both again come out of engagement and the contact bridge 13 has taken over the permanent current conductance FIG. 2 shows a further form of embodiment of the invention with a circular arrangement. Here, too, semiconductor switches 2 and 3 are provided that each have a separate electrical input 4 or 5 and that have a common electrical output 6. Here, contact rollers 22, 23, 24 each running on a respective contact ring 25, 26, 27 are provided. These contact rings 25 to 27 correspond in respect to their function with the contact rails 16 to 18 of FIG. 1. Fixed tap changer contacts 14 are here provided on a concentric circle. Moreover, a shunt ring 28 is shown that in turn is electrically connected with the load shunt.

Contact rollers 30, 31, 32, which are contactable with the fixed tap changer contacts, are provided in a first horizontal plane on a switch segment 28, which is again indicated only by a dashed line, of insulating material. Further contact rollers 33, 34, which run on the shunt ring, are provided in a second horizontal plane.

The contact roller is connected by way of the contact ring 25 with the input 4 of the first semiconductor switch 2 The contact roller 32 is connected by way of the contact ring 26 with the input 5 of the second semiconductor switch 3. The lower contact roller 33 is connected by way of the contact ring 27 with the common output 6 of the two semiconductor switches 2 and 3. The upper contact roller 31 and lower contact roller 34 finally have an electrically conductive connection 35 in such a manner that the contact roller 31, which is arranged physically between the contact rollers 30 and 32, is disposed in direct connection with the load shunt 28 by way of the lower contact roller 34.

In this embodiment the switching segment 29 and with it the contact rollers 30 to 34 execute a rotational movement on each occasion of switching.

However, the principle in terms of function is the same: in unchanging operation the respective fixed tap changer contact 48 is directly electrically connected with the shunt ring 28, whilst the semiconductor switches 2 and 3 are switched free. Only in the case of switching is a respective one of the two inputs 4 and 5—depending on the rotational direction—of the electronic power load changeover switch briefly connected by means of the associated contact roller 30 or 32 with the respective fixed tap changer contact 14 to be switched over to.

The invention claimed is:

1. A tap changer with semiconductor switching elements for uninterrupted switching between fixed tap changer contacts arranged along a path and electrically connected with respective winding taps of a tapped transformer, the tap changer comprising:

two semiconductor switching elements that each have a separate electrical input and that have a common electrical output, a mechanical contact system with a contact carriage movable along the path of the fixed tap changer contacts, four electrically conductive, but mutually insulated contact bridges fixedly arranged on the contact carriage, three electrically conductive, but mutually insulated contact rails parallel to the path of the fixed tap changer contacts, each of the rails being electrically connected with a respective one of the electrical inputs and the electrical output, and a further conductive shunt contact rail parallel to the contact rails and again electrically insulated relative thereto, the shunt contact rail in turn being electrically connected with the load shunt, the contact bridges being so dimensioned and physically arranged on the contact carriages that they cooperate with the contact rails or the shunt contact rail and through them, in dependence on switching, an electrical connection is selectably producible between one of the fixed tap contacts and the load shunt or one of the electrical inputs and a further electrical connection is selectably producible between the electrical output and the load shunt.

2. The tap changer according to claim 1, wherein the fixed tap changer contacts are arranged along a planar path and the contact carriages are linearly movable.

3. The tap changer according to claim 1, wherein the fixed tap changer contacts are arranged on a circular path concentrically about a fulcrum of the rotatable contact carriage.

4. The tap changer according to claim 1, wherein the semiconductor switching elements are insulated-gate bipolar transistors.

5. A tap changer for use with a transformer having a load shunt and an array of fixed tap contacts lying on a path and connected with respective windings of the transformer, the tap changer comprising:

two semiconductor switching elements each having an input and an output, the outputs being connected together;

first, second, third, and fourth contact rails in the transformer extending along the path, the first and second rails being respectively connected to the inputs of the switching elements, the third rail being connected to the connected-together outputs of the switching elements, the fourth rail being connected to the load shunt;

a carriage movable along the path; and first, second, third, and fourth electrically conductive but mutually insulated contact bridges carried by the carriage, the first, second, and fourth bridges being contactable with the fixed tap contacts, the first, second, third, and fourth contacts riding respectively on the first, second, third, and fourth rails, the third contact also riding on the fourth rail.

6. The tap changer defined in claim 5 wherein the fourth bridge being engageable with the tap contacts between the first and second bridges.

7. The tap changer defined in claim 5 wherein the path is straight.

8. The tap changer defined in claim 6 wherein the path is circular.

9. The tap changer defined in claim 5 wherein the elements are insulated-gate bipolar transistors.

* * * * *